United States Patent [19]

Hedger, Jr. et al.

[11] Patent Number: 4,618,098

[45] Date of Patent: Oct. 21, 1986

[54] FIBERGLASS SPRAY NOZZLE

[75] Inventors: James E. Hedger, Jr.; Joseph G. Charette, both of Goshen, Ind.

[73] Assignee: Graves Spray Supply, Inc., Goshen, Ind.

[21] Appl. No.: 548,632

[22] Filed: Nov. 4, 1983

[51] Int. Cl.[4] ..... B05B 7/06

[52] U.S. Cl. ..... 239/290; 239/424.5

[58] Field of Search ..... 239/290, 296, 419.3, 239/422, 424.5, 527; 138/42

[56] References Cited

U.S. PATENT DOCUMENTS

| | | | |
|---|---|---|---|
| 155,936 | 10/1874 | Fell . | |
| 1,655,254 | 12/1926 | Binks . | |
| 1,752,923 | 4/1927 | Mueller . | |
| 1,765,522 | 8/1925 | Birkenmaier . | |
| 1,897,173 | 4/1931 | Long et al. . | |
| 1,990,823 | 10/1933 | Gustafsson . | |
| 2,051,210 | 9/1935 | Gustafsson . | |
| 2,070,696 | 2/1937 | Tracy | 239/296 X |
| 2,126,888 | 4/1936 | Jenkins . | |
| 2,126,889 | 3/1937 | Jenkins . | |
| 2,210,480 | 8/1940 | Brice | 138/42 |
| 2,482,243 | 9/1949 | Burnham . | |
| 2,511,626 | 6/1950 | Einbecker | 239/419.3 X |
| 2,609,238 | 9/1952 | Anderson . | |
| 2,678,846 | 5/1954 | Rogers et al. . | |
| 2,709,623 | 5/1955 | Glynn . | |
| 2,780,496 | 2/1957 | Asbeck et al. . | |
| 2,904,262 | 9/1959 | Peeps | 239/408 |
| 3,033,472 | 5/1962 | Shelton V | 239/408 |
| 3,066,874 | 12/1962 | Becker | 239/415 |
| 3,096,225 | 7/1963 | Carr et al. . | |
| 3,111,272 | 11/1963 | Underdown et al. | 239/420 |
| 3,126,157 | 3/1964 | Dickerson | 239/415 |
| 3,179,341 | 4/1965 | Plos et al. | 239/414 |
| 3,185,396 | 5/1965 | Black | 239/330 |
| 3,198,434 | 8/1965 | Svrchek et al. | 239/79 |
| 3,330,484 | 7/1967 | Johnson et al. | 239/414 |
| 3,375,855 | 4/1968 | Deeks . | |
| 3,399,834 | 9/1968 | Bradley | 239/10 |
| 3,504,861 | 4/1970 | Peeps et al. | 239/300 |
| 3,507,451 | 4/1970 | Johnson | 239/305 |
| 3,542,296 | 9/1968 | Bradley | 239/300 |
| 3,659,790 | 5/1972 | Gelin | 239/336 |
| 3,676,197 | 7/1972 | Harrison et al. . | |
| 3,709,468 | 1/1973 | Ives . | |
| 3,788,555 | 1/1974 | Harrison et al. | 239/336 |
| 3,790,030 | 2/1974 | Ives | 222/135 |
| 3,829,016 | 8/1974 | Scharfenberger | 239/127 |
| 3,844,485 | 10/1974 | Waggoner | 239/420 |
| 3,893,621 | 7/1975 | Johnson | 239/422 X |
| 3,907,202 | 9/1975 | Binoche | 239/15 |
| 3,917,200 | 11/1975 | Johnson . | |
| 3,927,833 | 12/1975 | Harrison et al. | 239/300 |
| 4,029,442 | 6/1977 | Schlosser . | |
| 4,035,109 | 7/1977 | Drath et al. . | |
| 4,055,300 | 10/1977 | Binoche | 239/15 |
| 4,055,302 | 10/1977 | Hruby, Jr. | 239/102 |
| 4,123,007 | 10/1978 | Gardner | 239/414 |
| 4,142,682 | 3/1979 | Bowen | 239/488 |
| 4,166,410 | 9/1979 | Schlosser . | |
| 4,245,784 | 1/1981 | Garcin | 239/3 |
| 4,273,287 | 6/1981 | Huber | 239/299 |

FOREIGN PATENT DOCUMENTS

| | | | |
|---|---|---|---|
| 888227 | 7/1953 | Fed. Rep. of Germany | 239/296 |
| 2815246 | 10/1979 | Fed. Rep. of Germany | 239/296 |
| 735983 | 8/1955 | United Kingdom | 239/296 |

*Primary Examiner*—Joseph F. Peters, Jr.
*Assistant Examiner*—Kevin Patrick Weldon
*Attorney, Agent, or Firm*—Barnes & Thornburg

[57] ABSTRACT

A fiberglass spray nozzle arrangement is described for controlling the spray flow configuration of a resin-catalyst mixture which is atomized exteriorly of the nozzle. Resin nozzle, catalyst nozzle and control air nozzle devices are included in spaced apart relation in this nozzle arrangement. The resin nozzle sprays resin in a spray stream which is intersected by control air jets from the flow control nozzle and catalyst spray from the catalyst nozzle in series. The resulting spray mixture from a continuous flat fan having no splits or tails at the work.

19 Claims, 5 Drawing Figures

FIBERGLASS SPRAY NOZZLE

BACKGROUND AND SUMMARY OF THE INVENTION

The present invention relates generally to fluid spray nozzles and, more particularly, to multi-fluid component spray nozzles for use in low pressure, airless nozzle fiberglass spraying systems with external resin catalyst mixing.

Fiberglass spraying devices, and particularly hand held units, have previously employed a number of different spraying methods in attempts to provide well mixed, properly shaped fluid and spray flows in the most efficient manner possible. Typical fiberglass spraying apparatus supply fluid resin and fluid catalyst to a nozzle for internal or external mixtures. With internal mixing, catalyst fluid may typically first be atomized by mixing with air and then directed into the path of the fluid resin at the nozzle interior. After resin-catalyst mixing, the resulting fluid is forced through a common nozzle and directed at the work piece. Internal mixing requires time consuming and expensive cleaning of the nozzle and mix chambers after each use. With external mixing, both catalyst and resin fluid streams may typically be forced through separate spray nozzles prior to mixing. These nozzles are directed such that the catalyst and resin spray flows intersect to permit mixing prior to contact with the work piece. If the resin is not atomized prior to spraying, the process is often termed "airless". Such external mix sprayers may not need extensive cleaning after each use, but typically require high fluid pressures. Reinforcing fibers may typically be directed into the mixed spray path of either internal or external mix sprayers to be wetted thereby and carried to the work piece.

Major concerns in designing and operating fiberglass sprayers include providing a thoroughly mixed spray, to assure proper curing and work piece uniformity, as well as larger transfer efficiencies and lower operating costs. The term "transfer efficiencies" refers to the amount of material applied and adhering to the work product compared with the amount of waste material left in the atmosphere or elsewhere, such as the floor of the production room. Since fiberglass resin and catalyst materials are expensive and catalyst and spray mixture fumes present serious health hazards for production personnel, it is desirable to achieve as high a transfer efficiency as possible. Operating costs may be reduced by, for example, decreasing the amount of down time for system maintenance, repair, or cleaning and lowering the pumping pressure capacity needed. Further, if the spray flow fan is properly configured, production time itself may be reduced.

In prior fiberglass sprayers, the spray mixture flow stream, upon contact with the work piece or target, has generally had an oval cross-sectional configuration, taken through the logitudinal axis or axes of flow stream travel. Often, separation or "tails" from that oval shape have occured along the narrower sides. It is extremely desirable to have this cross-sectional flow configuration be as linear as possible, i.e., to have the major axis of the flow stream be many times greater than the minor axis, and to maintain uniformity of these dimensions along those axes to avoid discontinuities and tails. To the extent that such conditions are met, fabrication and spraying time, health injuries and material losses can be reduced, and fluid pump efficiency can be improved. In attempts to achieve the desired spray configuration, prior fiberglass sprayers have provided oval and V jet nozzles openings, and applied increased pumping pressure to the fluid resin to increase its velocity through those nozzle openings.

However, it is also important that resins, dyes, accelerators and other fluids be adequately mixed in with the base resin fluid stream. Merely increasing the resin fluid pressure to increase the resin spray velocity so as to maintain a thin, fanned spray flow configuration would not produce satisfactory results since the resultant fluid spray would not be adequately mixed under high fluid stream pressures. Without proper mixing of, for example, resin and catalyst fluids, the fiberglass curing rate will not be uniform. Increased fluid pressures also result in decreased pumping efficiency and higher pump operational costs and maintenance. Further, high velocity fiberglass sprays tend to "bounce" off the target and, thus, a certain amount of spray material is lost, reducing the transfer efficiency. If, as is often the case, the resin fluid is abrasive, increasing its velocity past the nozzle would also cause increased nozzle wear and necessitate frequent replacement, with the consequential down time for the entire system. As a result, it has often been found to be desirable to reduce the pump pressure on the liquid resin.

In an effort to avoid clogging of fluid streams in airless nozzles and to decrease spraying time, resin nozzles openings have also been enlarged. However, larger nozzle openings and lower operating pressures tend to reduce control over the spray flow configuration, produce more circular spray patterns, and often result in split or tail flow discontinuities in the spray pattern.

A number of prior patents have been directed to external mix resin-catalyst spray devices. U.S. Pat. Nos. 3,542,296, issued to Bradley, and 3,659,790, issued to Gelin, are representative of such patents showing fiber reinforced resin-catalyst spray apparatus. FIGS. 12 and 2, respectively, illustrate the resulting oval spray configuration. Significant flattening and uniformity in the spray flow configuration are not achieved. As a result, the transfer efficiencies of such devices is relatively low and the operating costs are increased.

Although it has been suggested, in U.S. Pat. Nos. 3,066,874, issued to Becker, and 3,507,451, issued to Johnson, that the spray flow configuration may be affected by air jets in the resin-catalyst spraying apparatus, these devices do not function to achieve the same results as the subject invention. Neither patent shows a sprayer which provides for adequate mixing of the catalyst and resin or for sufficient flattening of the spray flow. Further, these sprayers require substantially higher air jet pressures and volumes to fine tune the spray for configuration. Also, these devices are not well suited for spraying of heavy resins, such as some viscous polyesters. The Becker Patent shows the use of three independent nozzle openings for resin, catalyst, and control air. However, the control air jets of this device do not serve to flatten the spray flow. All three of these nozzle openings are arranged virtually concentricly at substantially the same location. The control air nozzle opening is generally circular and does not intersect the spray flow from opposing sides. Since the control air intersection is so close to the resin nozzle opening, substantial fine tuning of the spray flow is restricted.

The Johnson device has a complicated nozzle structure which serves a rather specific function. Air jets are provided on opposing wings spaced forwardly of the resin nozzle opening. However, these air jet openings are coincident with the catalyst nozzle opening so as to provide an aspiration force on the catalyst to draw it into the resin spray flow. As a result, independent control of catalyst atomization and spray flattening is not possible. In many circumstances, the catalyst will be excessively atomized, thus increasing the concentration of noxious fumes in the working areas, and the spray flow will be insufficiently flattened. Further, this arrangement does not provide adequate mixing of the resin and catalyst to cure properly the fiberglass on the target product. Although it has been generally suggested to employ control air jets in paint spraying apparatus to control the shape of the spray flow (Compare U.S. Pat. No. 1,990,823, issued to Gustafson, and U.S. Pat. No. 3,907,202, issued to Binoche), these paint spraying devices function differently to achieve different results with different materials, as compared to the fiberglass sprayers of the type contemplated by the present invention. The control air jets in the Gustafson and Binoche paint sprayers are shown to intersect the fluid flow fan from opposing sides at a point downstream or rebounding from the spray nozzle in attempts to flatten the spray fan. Such paint sprayers are not concerned with thorough intermixing of a plurality of reactive fluids in a primary fluid stream or with achieving an extremely smooth, flat spray with such a mixture. In fiberglass sprayers, on the other hand, proper fluid mixing can be critical. A smooth, flat resin spray flow can significantly assist resin-catalyst mixing and increase transfer efficiencies.

Further, paint sprayers are typically concerned with achieving a smooth finish on the work piece. This often requires fine atomization of the paint fluid to produce extremely small spray particles. Fiberglass sprayers typically are used for mold spraying wherein work piece finishes are determined largely by the mold surface. Thus, fine atomization of the spray mixture is not critical and, in many cases, is even undesirable as it tends to increase the concentration of harmful fumes and reduces transfer efficeincy. For these and other reasons stemming from the particular characteristics, such as lower viscosities, of paints, as opposed to fiberglass, paint sprayers generally operate at significantly higher fluid pressures, control air volumes, and spray flow velocities than hand held fiberglass sprayers.

It is therefore an object of the present invention to provide a means for flattening the configuration of a fluid spray flow and eliminating splitting of that flow in a fiberglass spraying apparatus.

Another object of the present invention is the provision of a nozzle arrangement for a fiberglass spraying system which permits low pressure atomization of a fluid mixture.

A further object of the present invention is to provide a fluid nozzle arrangement for producing a high volume, continuous linear spray flow configuration of a resin-catalyst mixture using minimal air jet and fluid pressure.

Still another object is to provide a fluid nozzle arrangement for atomizing heavy polyester resins at low fluid pressures in a two component, airless, external mix spray apparatus.

These and other objects are attained in the provision of a spray nozzle arrangement for a fiberglass spraying system having resin nozzle means, catalyst nozzle means, and control air nozzle means. The resin nozzle means includes a nozzle opening for spraying fluid resin as a resin stream. The catalyst nozzle means is spaced apart from the resin nozzle means and sprays the catalyst such that it intersects and mixes with the resin stream downstream from the resin nozzle opening. The control air nozzle means directs air flow to intersect the resin stream upstream of the mixture of the resin and catalyst. This arrangement permits the spray pattern or configuration of the resin-catalyst mixture to be controlled by controlling the low volume air flow through the flow control nozzle means so as to prevent splitting or tail formation of that flattened spray pattern and provides improved resin-catalyst mixing.

In an especially preferred embodiment of the subject invention, the catalyst nozzle means and the control air nozzle means each include a plurality of nozzle openings. At least one catalyst nozzle opening and one control air nozzle opening are disposed on each of two lateral side wings extending from and on opposite side of the resin nozzle opening. The control air rebounds off the resin nozzle to intersect the resin spray. Catalyst spray intersects the resin spray downstream from this control air intersection. In an alternative embodiment, control air intersects the material spray directly without such rebounding. In another alternative embodiment, only a single lateral side wing for catalyst is employed. Other advantageous features include the use of a pressure equalizing chamber in the liquid resin flow line upstream from the resin nozzle means to aid in low pressure atomization and flow control of that resin. Further, the three nozzle means can be contained within a unitary housing.

Since the control air intersects the resin spray flow directly, the resulting spray is more uniform. Thus, the pump pressure on the liquid resin and the velocity of the resin through the nozzle opening can be decreased with no loss of net spraying efficiency. This type of flattening of the resin spray permits much more effective fine tuning of the mixture flow. Further, auxiliary control air nozzle openings for additional shaping jets can be positioned at additional locations perpendicular to the nozzle openings for control air which define the spray flow. These auxiliary openings permit control air to alter the width of the spray flow fan as well as its thickness. By increasing the size of the nozzle opening and decreasing the resin fluid pressure in conjunction with such low volume control air, the present invention has shown, in particular embodiments, significantly improved transfer efficiencies, such as to about 80%.

Other objects, advantages, and novel features of the present invention will become apparent when the following detailed description of the preferred embodiments is considered in light of the attached drawings.

DETAILED DESCRIPTION OF THE DRAWINGS

Figure 1:
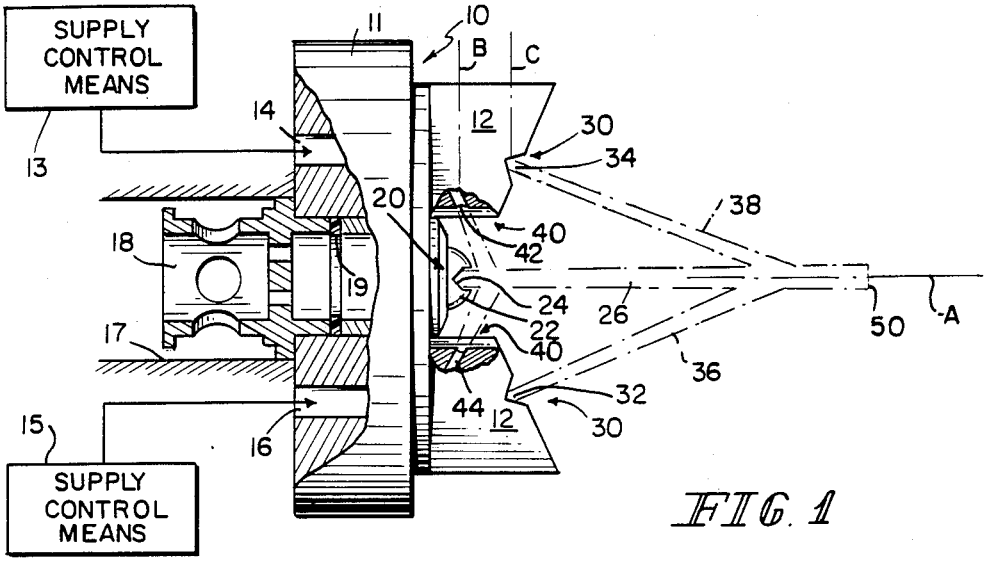
FIG. 1 shows a side view of a preferred embodiment of the present invention with a partial cross sectional view of the nozzle housing.

FIG. 1, which illustrates a preferred embodiment of the present invention, shows a unitary nozzle housing 10 having resin nozzle means 20, catalyst nozzle means 30, and control air nozzle means 40 therein. Nozzle housing 10, for example, may be readily attached to the spray gun of a commercially available fiberglass spraying apparatus for fiber-reinforced or gelcoat operations, such as the Magnum manufactured by the assignee of the present application, Graves Spray Supply, Inc. of Goshen, Ind. Although these three nozzles means are illustrated within a unitary housing, the present invention also contemplates the use of separate housing means for each nozzle means.

In a particularly advantageous embodiment, nozzle housing 10 is formed with side fan wings 12 on the forward face thereof and disposed laterally of resin nozzle means 20 and with control air supply port 14 and catalyst supply port 16 on its inward or rearward face. Generally, two opposing wings are employed in fiberglass spraying devices according to the present invention. However, in certain gelcoat spraying where only a single wing is necessary. Connected to and upstream from each of these supply ports respectively are supply control means 13 and 15. As these control means and supply port arrangements may be of types generally well known in the art, they will not be discussed in detail herein. Another advantageous feature of the present invention is the inclusion of pressure equalizing means 18 in nozzle housing 10 to form a liquid resin chamber between resin supply means 17 and bearing means 19, adjacent resin nozzle means 20.

Resin nozzle means 20 can be a separable unit inserted into housing 10 and includes tip 22 having nozzle opening 24 therein. Tip 22 may, for example, be formed from a hardened steel or other material resistant to abrasion by liquid resin. It has been found to be advantageous to form nozzle opening 24 by an angular cut 15° to 80° wide in forward portion of tip 22 such that a central oval opening is created. This opening is large relative to nozzles of conventional paint sprayers to compensate for the greater viscosity of fiberglass resin. Nozzle opening 24 permits resin to spray forwardly as stream 26 having a longitudinal flow axis A. By enlarging the orifice size, a greater volume of resin can be sprayed at a decreased pressure. However, it has generally been found to be necessary that a predeterminable minimum fluid pressure is maintained, depending upon fluid viscosity, in order to produce a flattened or oval spray flow even from an oval nozzle. In particular embodiments of the present invention, it has been found to be advantageous to supply polyester resin at a pump delivery pressure of only 180–250 psi and gelcoat resins at a pump delivery pressure of only 400–1000 psi.

In less complex embodiments of the present invention catalyst nozzle means 30 includes two nozzle openings 32 and 34 each mounted on fan wings 12. These nozzle openings are spaced apart from resin nozzle opening 24 laterally and disposed longitudinally downstream along flow axis A. Although the figures show a plurality of fan wings, the present invention also contemplates that only a single fan wing may be necessary when used in, for example, some gelcoating operations. With two fan wing embodiments, it has often been found to be advantageous to align openings 32 and 34 oppositely of each other and directed along the flow of resin spray stream 26 in a plane C perpendicular to that flow, as shown in FIG. 1. Nozzle openings 32 and 34 are formed by angular cuts from 5° to 120° wide in the forward surfaces of fan wings 12 such that central oval openings are created. These openings permit catalyst to spray out along streams 36 and 38 to intersect and thoroughly mix with the flattened resin stream 26 downstream of the resin nozzle means. Fluid catalyst may be atomized prior to spraying through openings 32 and 34, by, for example, premixing with air upstream from housing 10. In order to prevent the release of excessive catalyst fumes in the work area and to improve resin-catalyst mixing, catalyst nozzle openings 32 and 34 should be spaced apart from control air jets by a discrete distance. This spacing should be such that the catalyst spray does not intersect the control air and that the distance between the control air-resin spray intersection and the catalyst-resin spray intersection is not less than 0.25 inch (0.63 cm). In particular embodiments, the optimum distance between such intersections has been found to be about one inch (2.54 cm).

Figure 2:
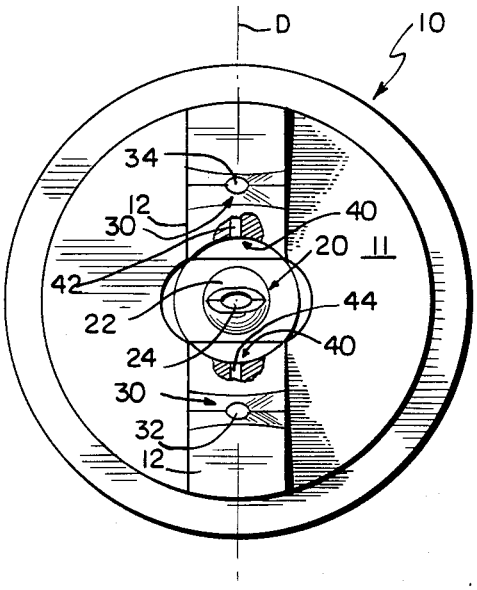
FIG. 2 shows a front view of the embodiment illustrated in FIG. 1.

In other embodiments of the present invention control air nozzle means 40 includes a plurality of openings 42 and 44 each mounted on fan wings 12. Openings 42 and 44 may be spaced apart laterally and disposed longitudinally along spray stream 26 from both resin nozzle means 20 and catalyst nozzle means 30. It has also been found to be advantageous to position openings 42 and 44 oppositely of each other and directed along the flow of resin spray stream 26 in a plane at a 15° angle to that flow and laterally aligned with openings 32, 34 and 24 along axis D, as shown in FIGS. 1 and 2. Openings 42 and 44 are formed as jet ports for control air in the sides of fan wings 12. These jet ports permit control air to flow as air jets to intersect resin stream 26 at, for example, an acute angle downstream and adjacent to resin nozzle means 20 and upstream from the intersection of resin stream 26 with catalyst streams 36 and 38. Alternatively, air jets may contact resin stream 26 by first rebounding off resin nozzle means 20. It has been found to be advantageous to rebound the control air off the nozzle when the surface area of the resin spray stream emerging from the nozzle is relatively large, i.e., with larger nozzle openings. Control air immediately impinging upon these larger spray streams often requires greater volumes of air to achieve the same amount of spray flow shaping as rebounded control air. The number and size of control air nozzle openings is dependent upon the volume of air and operating pressure sought in particular embodiments. In general, less openings and less control air volume will be necessary where air jets rebound off resin nozzle means 20.

Figure 3:
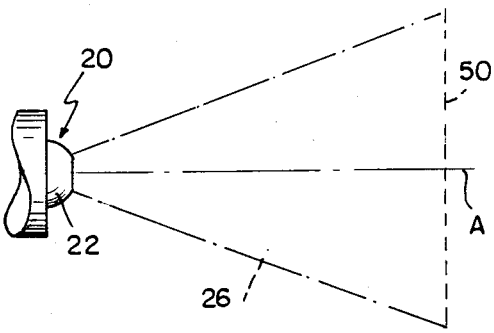
FIG. 3 shows a top view of a portion of the embodiment illustrated in FIG. 1 along with the resulting spray flow pattern.
Figure 4:
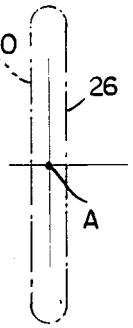
FIG. 4 shows a crosssectional view of the spray flow pattern illustrated in FIG. 3 taken along on axis laterally perpendicular to axis A shown in FIG. 4.

In light of the above description, operation of the present invention will now be readily apparent to those skilled in the art, and, thus, will only be briefly discussed below. The spray nozzle arrangement of the present invention, which combines nozzle opening configuration and intersecting fluid and air flows, permits the formation of a resin-catalyst mixture spray flow 50 having a generally flat, fanned shape at the work area. By adjusting air supply control means 13, the flow of control air through openings 42 and 44 may be altered independently of either the resin or catalyst spray flows to establish predetermined resin-catalyst mixture flow configurations for given resin and catalyst spray supply levels. Since the intersection of control air with resin stream 26 may be spaced apart in a separate stage from the intersection of catalyst streams 36 and 38 with the resin stream, fine tuning of the flow configuration may be achieved merely with air supply adjustment and tails or split fingers in the resulting spray will be avoided. Further, since the resin stream is flattened by control air prior to resin-catalyst spray mixing and under a reduced pressure, the intersecting catalyst spray is much more uniformly mixed with the resin. Thus, a thoroughly mixed, continuous, linear flow fan having a constant cross-sectional width perpendicular to the longitudinal axis of flow A may be created, as shown in FIG. 3 and 4.

By rebounding the air off the resin nozzle means 20 and intersecting the resin stream at acute angles, the control air bombardment may efficiently atomize the resin spray along longitudinal axis of flow A even as the catalyst spray intermixes. Therefore, the pressure on the fluid resin upstream from resin nozzle means 20 may be decreased and/or the size of opening 24 increased with no loss of spraying efficiency. The air flow control system of the present invention is particularly effective with viscous polyester resins which would ordinarily resist spray flow flattening. An advantageous feature of the present invention is to permit a large volume of fiberglass mixture to be laid evenly and smoothly over the work piece.

Further, the formation of such fan shaped spray flows may be aided by the presence of pressure equalization chamber 18 upstream from resin nozzle means 20. This chamber helps remove turbulence and nonlaminar flow in the resin spray which would tend to create noncontinuous spray mixture flows.

Figure 5:
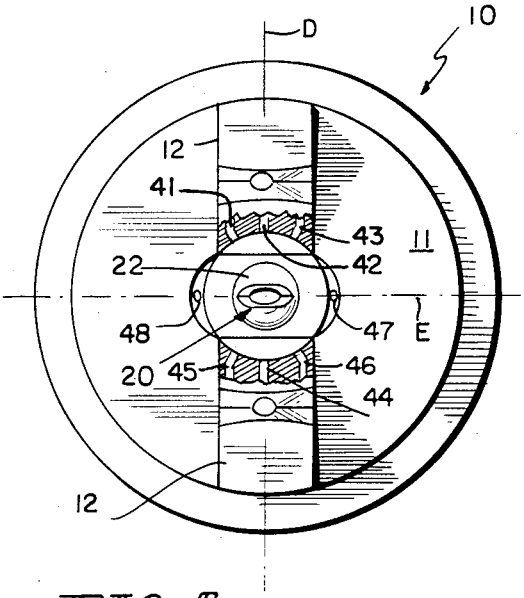
FIG. 5 shows a front view of a modification of the embodiment shown in FIG. 2 according to another embodiment of the present invention.

FIG. 5 shows a further embodiment of the present invention which employs additional control air openings 41 and 43 adjacent opening 42, openings 45 and 46 adjacent opening 44 and openings 47 and 48 disposed oppositely of each other on forward face 11 of housing 10 along axis E, perpendicular to alignment axis D. These additional openings permit further adjustment and fine tuning of the configuration of mixture flow 50. Control air openings 41–46 serve to define spray flow along the minor axis of the fan; control air openings 47 and 48 serve to define spray flow along the major axis of that fan. Again, these additional openings produce control air which either rebounds off of resin nozzle means 20 or which intersect the resin spray stream directly.

Although the present invention has been described above in detail, the same is by way of illustration and example only and is not to be taken as a limitation. The spirit and scope of the present invention are limited only by the terms of the appended claims.

What is claimed is:

1. A fluid spray nozzle apparatus for use in airless, low pressure spraying of resin-catalyst mixtures to combine multiple intermixing fluid streams to form a continuous, substantially flat sheet fluid stream, comprising:

resin nozzle means for low pressure, airless spraying of resin fluid as a resin stream for external atomization, said resin nozzle means having an oval opening to initially flatten said resin stream;

catalyst nozzle means for spraying of catalyst as a catalyst stream for intersecting and intermixing with said resin stream;

control air nozzle means for directing control air flow to intersect said resin stream adjacent said resin nozzle means and upstream and spaced apart from said intersection of said catalyst stream with said resin stream such that said resin stream is further flattened by said control air and formed without tail or split flows; and said catalyst stream intersects said resin stream downstream from said subsequent to the flattening of said stream by said oval opening and said control air, said flattening of said resin stream also serving to enhance said intermixing of said catalyst stream with said resin stream.

2. The apparatus according to claim 1, further including fluid pressure equalizing chamber means upstream of said resin nozzle means.

3. The apparatus according to claim 1, wherein said catalyst nozzle means includes a plurality of catalyst nozzle openings and said control air nozzle means includes a plurality of control air nozzle openings, and wherein said catalyst nozzle openings are disposed in a first plane and said flow control air nozzle openings are disposed in a second plane, and wherein said second plane is upstream of said resin stream with respect to said first plane.

4. The apparatus according to claim 1, wherein said apparatus further includes fan wing means mounted laterally of said resin nozzle means.

5. The apparatus according to claim 1, wherein said control air nozzle means and said catalyst nozzle means are disposed on said fan wing means in spaced apart relation.

6. A spray nozzle arrangement for a low pressure fiberglass spray system, comprising:

a resin nozzle means for low pressure spraying of resin as a resin stream out of a resin nozzle opening means, said resin nozzle opening means having an oval shape to initially flatten said resin stream;

catalyst nozzle means, spaced apart from said resin nozzle means, for spraying catalyst as a catalyst stream that intersects and intermixes with said resin stream at a predetermined distance from said resin nozzle opening means;

control air nozzle means for directing control air flow to intersect said resin stream adjacent to said resin nozzle means and upstream and spaced apart from said intersection of said catalyst stream with said resin stream such that the spray pattern of the resin stream is further flattened by said control air and is controlled to assume a predetermined flattened and continuous configuration by the application of said control air to said resin stream; and said catalyst stream intersects said resin stream downstream from and subsequent to the flattening of said resin stream by said resin nozzle opening means and said control air, said flattening of said resin stream also serving to enhance said intermixing of said catalyst stream with said resin stream.

7. The spray nozzle arrangement according to claim 6, wherein the resin nozzle opening means is centrally disposed in said resin nozzle means, and wherein said resin nozzle means is an airless nozzle.

8. The spray nozzle arrangement according to claim 6, wherein said arrangement includes pressure equalizing means for providing laminar flow of said resin upstream of said resin nozzle opening means.

9. The spray nozzle arrangement according to claim 6, wherein said catalyst nozzle means includes a plurality of catalyst nozzle opening means, at least one of which is disposed at a lateral side of said resin nozzle means opposite from the lateral side of another of said catalyst nozzle opening means.

10. The spray nozzle arrangement according to claim 9, wherein said catalyst is at least partially atomized within said arrangement by mixing with air prior to spraying by said catalyst nozzle means.

11. The spray nozzle arrangement according to claim 9, wherein said resin nozzle opening means includes an oval opening formed from an angular cut of between 15 and 80 degrees, and wherein said catalyst nozzle opening means includes an oval opening formed from an angular cut of between 5 and 120 degrees.

12. The spray nozzle arrangement according to claim 6, wherein said control air flow rebounds from said resin nozzle opening means to intersect said resin stream adjacent said resin nozzle means and at an acute angle.

13. The spray nozzle arrangement according to claim 6, wherein said control air nozzle means includes a plurality of control air nozzle opening means, spaced apart from said resin nozzle opening means, for directing control air flow to intersect said resin stream at acute angles downstream of said resin nozzle opening means.

14. The spray nozzle arrangement according to claim 13, wherein said control air nozzle opening means are disposed on opposite lateral sides of said resin nozzle opening means.

15. The spray nozzle arrangement according to claim 13, wherein said control air nozzle opening means are disposed on two pairs of opposite lateral sides of said resin nozzle opening means so as to define the major and minor axis of said predetermined configuration of said mixture spray pattern.

16. The spray nozzle arrangement according to claim 6, wherein said apparatus includes means for adjusting the supply of air to said control air nozzle means to alter said configuration of said mixture spray.

17. The spray nozzle arrangement according to claim 6, wherein said predetermined configuration of said spray mixture is a substantially continuous, linear fan having a cross-sectional thickness which is substantially uniform across a cross-sectional width orthogonal to the longitudinal axis.

18. The spray nozzle arrangement according to claim 6, wherein said resin nozzle means, said catalyst nozzle means, and said control air nozzle means are contained within a unitary housing means.

19. The spray nozzle arrangement according to claim 6 wherein the distance between the intersection of said control air and said resin stream and the intersection of said catalyst stream and said resin stream is not less than 0.25 inch.

* * * * *